US005913615A

United States Patent [19]

Rellinger

[11] Patent Number: 5,913,615

[45] Date of Patent: Jun. 22, 1999

[54] OPEN-CLOSED SIGN STRUCTURE

[75] Inventor: Michael Rellinger, Cook County, Ill.

[73] Assignee: Quartet Manufacturing Company, Skokie, Ill.

[21] Appl. No.: 08/419,026

[22] Filed: Apr. 10, 1995

[51] Int. Cl.[6] ..... G09F 11/00

[52] U.S. Cl. ..... 40/491; 40/375

[58] Field of Search ..... 40/491, 508, 489, 40/490, 449, 594, 595, 597, 600, 907, 325

[56] References Cited

U.S. PATENT DOCUMENTS

| | | | |
|---|---|---|---|
| 854,971 | 5/1907 | Thomas | 40/375 X |
| 3,604,133 | 9/1971 | Hawa | 40/491 |
| 4,217,713 | 8/1980 | Greenberger | 40/491 X |
| 4,953,315 | 9/1990 | Romaine | 40/597 X |
| 5,027,406 | 6/1991 | Hofman | 40/597 X |
| 5,289,589 | 2/1994 | Hyatt | 40/491 X |

FOREIGN PATENT DOCUMENTS

| | | | |
|---|---|---|---|
| 273095 | 9/1913 | Germany | 40/491 |

*Primary Examiner*—Cassandra H. Davis

*Attorney, Agent, or Firm*—Martin Faier; Faier & Faier P.C.

[57] ABSTRACT

An open—closed sign structure fabricated and assembled from a pair of like sign body sections arranged back to back to form a sign body and having an area spaced apart between them, the sign body carrying a sign face visible from either side, wherein a shutter consisting of a pair of like shutter sections keyed together at a corresponding edge of each shutter section is engaged for slidable movement between the sign body sections, each shutter section carrying indicia visible from one face of the shutter selectively on opposed edges of the sign body depending upon the position of the shutter relative to the sign body, and fasteners for holding the sign body sections together and the shutter slidably engaged therebetween. The fasteners may also have mounting members, such as suction cups, for securing the assembled sign to a surface. The shutter and sign body also have a cam and detente assembly for urging the shutter to remain in a predetermined selected position visible from a selected edge of the sign body. The sign face may consist of ridged magnetic panels, one carried by each of the sign body sections, and magnetized letter indicia adapted for movable securement on the sign face aligned on the magnetic panel ridges.

17 Claims, 2 Drawing Sheets

FIG. 1
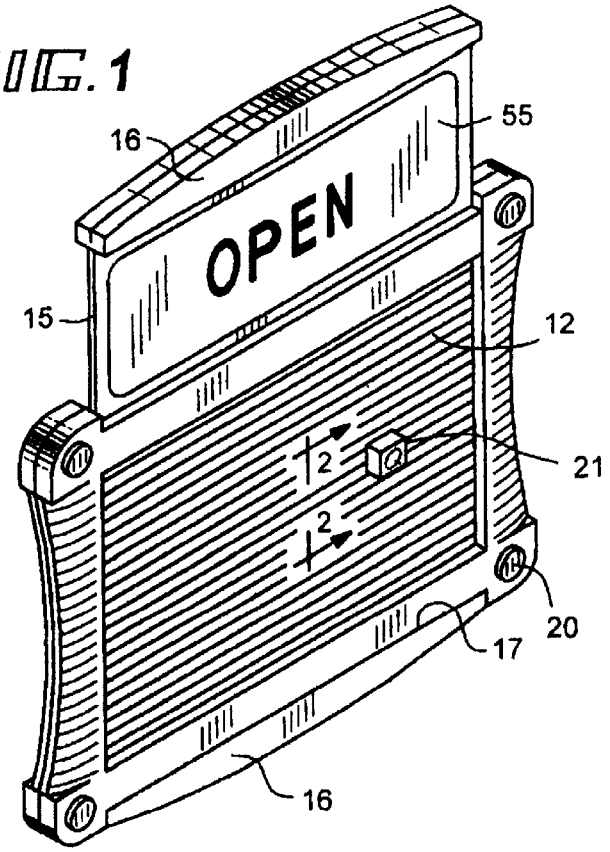
FIG. 2
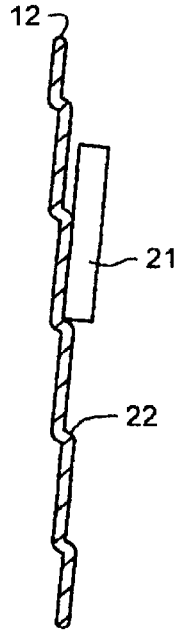
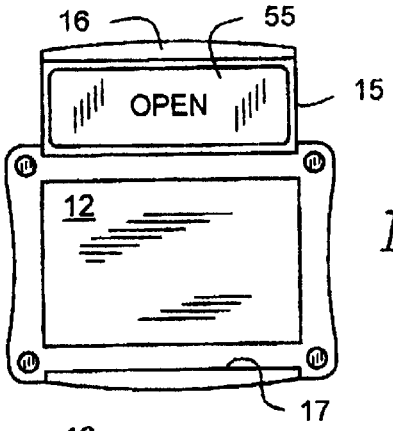
FIG. 3
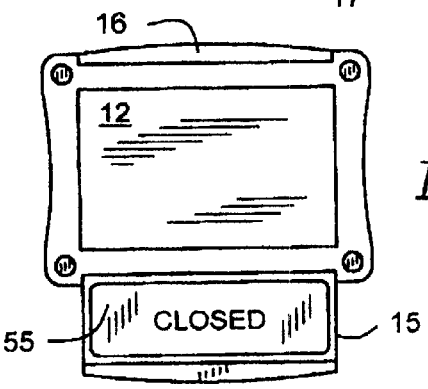
FIG. 4
FIG. 5
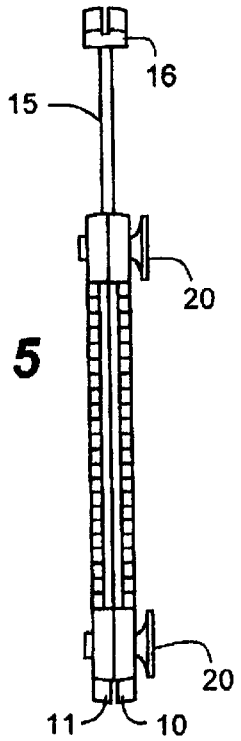

FIG. 6
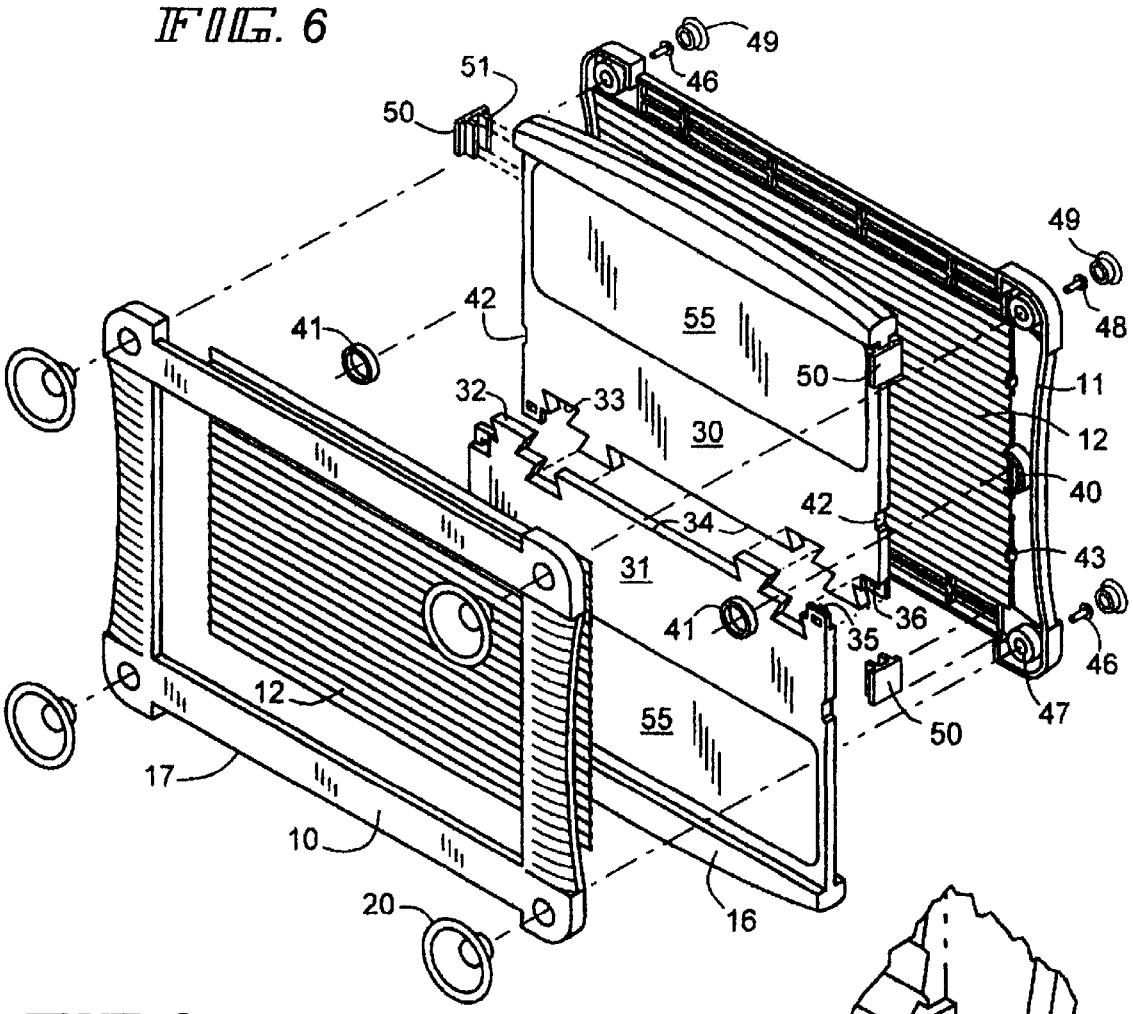
FIG. 8
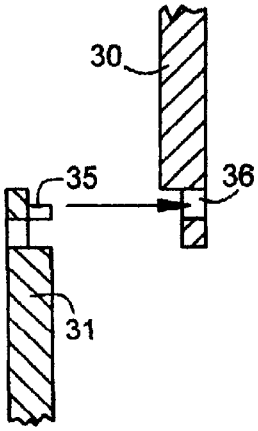
FIG. 9
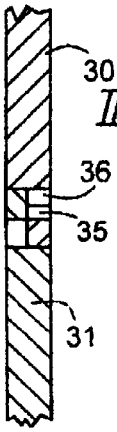
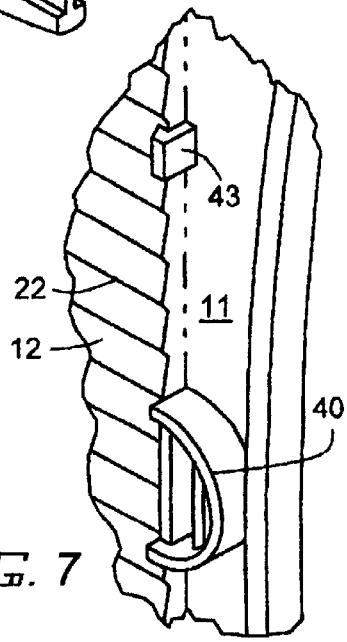
FIG. 7

OPEN-CLOSED SIGN STRUCTURE

BACKGROUND AND SUMMARY OF THE INVENTION

This invention relates to a new and improved open—closed sign structure of the kind which may be used at the entry of a business or institution, not only to provide information to persons desiring to enter the establishment, but also to convey announcements, which may be easily changed, upon exiting the premises. The sign has shutter means to selectively indicate whether the business is open or closed, and may also include other indicia such as hours of operation or other information, which can be easily modified as desired by the user.

Open—Closed Signs having shutters are well-known in the prior art, and these devices generally consist of a sign body with means for entrapping therein a selectively movable shutter which when in one selected position displays one indicia, such as the word "open" and in another selected position display another indicia, such as the word "closed". Such signs frequently carry means for displaying a more permanent message, such as a changeable letter sign on which may be displayed hours of operation or other messages. These signs are usually secured to a window or door lite so that they may be viewed from either side or face, and they may be secured to a glass surface by means of suction cups arranged on the sign body.

James A. Hofman U.S. Pat. No. 5,029,406, granted Jul. 9, 19091, for SIGN STRUCTURES, is exemplary of such prior art "Open—Closed Signs", and also discusses pre-existing prior art for such devices. However, such prior art signs lack the novel structural features of the present invention, as hereinafter discussed.

The sign disclosed in this application embodies the attributes of the prior art, and, additionally, has novel like sign body sections which comprise the sign body when assembled together and carry a changeable letter board, and the assembled sign body also has means for slidably securing a shutter therein and holding the shutter in a selected position. This shutter consists of like panels which when reversed are keyed together and which slide in the sign body.

Arranged on opposed sides of the sign body are novel cam ring brackets, each of which holds a cam ring, and each shutter part has a corresponding detente which may be urged into a corresponding cam ring to secure the shutter in a predetermined open or closed position for displaying selected indicia. The indica may be changed to other indicia on the opposed edge of the shutter by urging the detente away from the ring to freely slide the shutter to another selected position where the detente on the other shutter panel engages the cam ring.

The above described arrangement for changing the sign from "Open" to "Closed" position, or vice versa, can be accomplished from the front or back sign of the sign, because the shutter crown is available from the top or bottom edge of the sign body. This arrangement also leaves both the face and reverse sides of the sign body free for display any special indicia desired.

The changeable letter boards which can form a part of the open-closed sign likewise may have novel magnetic panel members which include parallel ridges against which individual letters may be oriented in straight lines for neatly lining up and locating the components on the sign. These magnetic panel members and the letter indicia can be constructed of thinner configuration that conventional changeable letter signs and letters, and allow for mounting of changeable signs on both the face and rear sides of the sign board.

Fasteners may be arranged through corresponding corners of the sign bodies to hold the sign bodies together with the slidable shutter sections therebetween, and suction cups for mounting the sign to a selected surface may be secured to the fasteners along one face of one of the sign bodies.

This open closed sign summarized above is attractive and sturdy and easy and relatively inexpensive to manufacture, preferably by molding from plastic material. Such a sign has a small number of molds because the sign bodies and shutter panels are each made from a pair of like parts arranged together in a novel fashion. A sign constructed according to the present invention may be assembled by simply snapping together the shutter sections and threading the screws through the sign body sections, without special tools or adhesives or secondary forming or cutting operations common to prior art devices.

Such a sign provides superior means for communicating an open and closed or similar condition, and allows for more permanent messages to be easily arranged and re-arranged on the sign board. This device also has multiple sign surfaces, so that many messages may be displayed and expeditiously changed.

OBJECTS AND ADVANTAGES OF THE INVENTION

It is the object of the invention to provide an open - closed sign of the character described.

Another object is to provide a sign body for a sign which is fabricated and assembled from a pair of like sign body sections arranged back to back.

Another object is to provide a shutter for a sign which is fabricated from a pair of like shutter sections arranged in reverse position edge to edge at corresponding edges and keyed together by a hook and eye and keyway assembly.

Another object is to provide a sign having a shutter fabricated from like shutter sections and arranged in a sign body fabricated and assembled from like body sections.

Another object is to provide a sign and shutter arrangement having cam and detente members for positively urging the shutter to remain in a predetermined position.

Another object is to provide a novel ring bracket member on a pair of corresponding sign bodies, a ring member in the bracket and detentes on a shutter corresponding to the ring member for selectively securing the shutter in one of multiple positions.

Another object is to provide a novel key and keyway arrangement on a pair of like shutter sections positioned and dimensioned to hold the shutter sections in position when assembled together edge to edge.

Another object is to provide a sign assembled from like body sections arranged over a slidable shutter and fastened at the body panel corners with fasteners having suction cups for mounting on a selected surface.

Another object is to provide a sign having sign boards secured to each of a pair of like body panels wherein a slidable shutter may be selectively positioned relative to the sign boards.

Another object is to provide an open—closed sign having a magnetic sign board which has a plurality of horizontally arranged ridges for aligning selected magnetized sign letters on the sign board.

Another object is to provide an open—closed sign having a shutter member adapted for selectively displaying selected indicia and a changeable letter sign board visible from opposed faces of said sign.

It is also the object of the present invention to provide an open—closed sign which is sturdy and attractive and is easy and relatively inexpensive to manufacture from molded parts assembled together, requiring no secondary fabicating operations, and very efficient in use.

These and other objects and advantages will become more apparent as this description proceeds.

DESCRIPTION OF THE DRAWINGS

In the drawings,

FIG. 1 is a perspective view of an open—closed sign embodying the present invention.

FIG. 2 is a sectional view of a sign board with a letter mounted thereon, taken on line 2—2 of FIG. 1.

FIG. 3 is a plan view of a face of the open—closed sign embodying the present invention, with the shutter shown in the "up" or "OPEN" position.

FIG. 4 is a plan view of the sign similar to FIG. 3, except the shutter is shown in "down" or "CLOSED" position.

FIG. 5 is an end view of the sign shown in FIG. 3, with the shutter in "up" position.

FIG. 6 is an exploded view of the sign components.

FIG. 7 is an enlarged perspective view of part of the sign body, and the board, its mounting and cam ring bracket.

FIG. 8 is a detail sectional view showing the hook and eye tab connection of the shutter sections before they are connected.

FIG. 9 is a detail sectional view of the shutter sections shown in FIG. 8, except in connected condition.

DESCRIPTION OF A PREFERRED EMBODIMENT

A preferred embodiment of the open—closed sign embodying the present invention has a pair of like sign body sections 10 and 11 arranged back to back and having secured to each section a sign board 12, which may comprise a sheet of metallic magnetized material. Secured for slidable movement between the sign body sections 10 and 11 is a shutter 15, which preferably has a crown 16 adapted for engagement within a recess 17 on the body sections 10 and 11.

Mounting means, such as suction cups 20, may be used on each corner of the face of the body sections to mount the sign on a selected surface, such as a window or door lite. Preferably, the upper face of the shutter may bear indicia such as the word "OPEN" and the lower face of the shutter may have indicia such as the word "CLOSED". Sign letters, such as magnetized blocks 21, may be placed on the sign board 12, and their spacing in horizontal rows may be easily arranged by abutting the blocks against a plurality of parallel ribs 22 formed in the sign board.

The shutter 15 comprises a pair of like shutter sections 30 and 31, which are joined together by keys 32 and keyways 33 formed on cooperating edges 34 of each shutter section. Preferably, the remote ends of each edge 34 have a hook 35 and an eye 36 which interlock when the shutter sections 30 and 31 are twisted on their edges 34 relative to one another; and the hook 35 positively connects with the eye 36.

Formed midway the height of each of the sign body sections 10 and 11 is a bracket 40, preferably semi-circular, and a relatively flexible ring 41 fits in each semi-circular bracket. A notch or detente 42 is formed on the edge of each of the shutter sections 30 and 31 and is sized and positioned to accommodate the corresponding ring 41, to hold the assembled shutter 15 in a selected position, either "OPEN" or "CLOSED", but which allows the shutter to be moved to an opposed position upon sufficient detente force to move the notch 42 out of contact with the ring 41.

Also formed on each of the body sections 10 and 11 are a plurality of barbed brackets 43 for securing the sign boards to the body sections, when snapped into place within the associated barb of the relative body section.

The means for mounting the assembled sign to a surface, such as a window or door lite, may comprises a plurality of suction cups 20, one in each corner of the device. These suction cups 20 may be mounted by means of screws 46 threaded through reinforced bushing areas 47 in the corners of the sign body sections 10 and 11, and the heads 48 of these screws may be concealed by plugs 49. Slide guides 50 may also be provided adjacent each corner of the body sections 10 and 11 beneath the crown 16 of the shutter 15, and these slide guides 50 each have a channel 51 in which the edges of shutter 15 slide.

Panels 55 may also be provided on corresponding faces of the shutter sections 30 and 31 upon which indica, such as a pressure sensitive OPEN or CLOSED sign stickers may be affixed or which may be silk screen printed on the panels.

While a preferred embodiment of the invention has been shown and described in considerable detail, it should be understood that many changes may be made in the structure without departing from the scope or spirit of the invention. Accordingly, it is not desired that the invention should be limited to the exact structure disclosed.

The following claims are made:

I claim:

1. A sign structure comprising:

(1) body sections forming a peripheral frame having opposed edges,
  (a) said body sections each being substantially identical, and
  (b) arranged back to back to form said frame;

(2) front and back sign faces arranged between said body sections within said frame,
  (a) said sign faces and body sections having a spaced apart area arranged between them defining a slot extending between said opposed frame edges,
    (i) at least one of said sign faces comprising a magnetic member secured on said frame,
  (b) said sign faces being secured between said body sections;

(3) shutter means mounted in said slot and adapted for reciprocal movement for a predetermined distance in said frame, said shutter means having
  (a) opposed ends adapted to define said distance of shutter movement in said frame,
  (b) a stop on at least one of said opposed ends adapted to prevent removal of said shutter means from said slot, and
  (c) indicia areas adjacent each of said ends,
    (i) one of said indicia areas on one end of said shutter means being exposed when the stop on its opposed end is moved against said frame.

2. In the sign structure recited in claim 1, wherein a plurality of inwardly projecting barbs on each of said body sections engage said magnetic member.

3. In the sign structure recited in claim 1, wherein said frame has mounting means for securing one of said faces of said sign structure to a selected surface.

4. In the sign structure recited in claim 3, wherein said mounting means secures said body sections together.

5. In the sign structure recited in claim 4, wherein said mounting means has a plurality of suction cups for securing said sign structure to said window.

6. In the sign structure recited in claim 1, wherein at least one of said sign faces has a plurality of spaced apart horizonal parallel ribs arranged thereon.

7. In the sign structure recited in claim 6, wherein said ribs have lands disposed between the ribs which are angularly tapered from rib to ribs along the sign faces.

8. A sign structure comprising:

(1) body sections comprising a peripheral frame having opposed edges;

(2) front and back sign faces arranged between said body sections within said frame, (a) said sign faces and body sections having a spaced apart area arranged between them defining a slot extending between said opposed frame edges;

(3) shutter means mounted in said slot and adapted for reciprocal movement for a predetermined distance in said frame, said shutter means having (a) opposed ends and a stop on each of said opposed ends adapted to define said distance of shutter movement in said frame and to prevent removal of said shutter means from said slot, and (b) indicia areas adjacent each of said ends, (i) one of said opposed ends of said shutter means being exposed when said stop is moved against said frame; and (4) guide means for controlling movement of said shutter means in said slot, (a) said guide means having means for engaging said shutter means against said frame for inhibiting movement of said shutter means, (b) said engaging means comprising cooperating ring and detente members On said frame and said shutter means.

9. In the sign structure recited in claim 8, wherein said frame and each of said stops has a shape adapted to receive its said related stop within its related frame edge when aid shutter in moved against said frame.

10. In the sign structure recited in claim 8, wherein said guide means comprises members arranged along said slot for holding said shutter means in position during movement.

11. In the sign structure recited in claim 10, wherein said members have a slide guide in which the shutter means slides.

12. In the sign structure recited in claim 10, wherein said guide means has means for engaging said shutter means against said frame edges inhibiting movement of said shutter means.

13. In the sign structure recited in claim 8, wherein said ring member is flexibly secured in a bracket formed in said body sections.

14. A sign structure comprising:

(1) body sections forming a peripheral frame having opposed edges, (a) said body sections each being substantially identical, and (b) arranged back to back to form said frame;

(2) front and back sign faces arranged between said body sections within said peripheral frame, (a) said sign faces and body sections having a spaced apart area arranged between them defining a slot extending between said opposed frame edges;

(3) shutter means mounted in said slot adapted for reciprocal movement for a predetermined distance in said frame, said shutter means having (a) opposed ends on said frame, (b) a stop one on each of said opposed ends adapted to define said predetermined distance of shutter movement in said frame and to prevent removal of said shutter from said slot, (i) said stop adapted to overlay both of said body sections when reciprocated, and (c) indicia areas adjacent each of said ends, (i) one of said indicia areas on one end of said shutter means being exposed when the stop on its said one opposed end is moved against said frame; and (d) said shutter means having like shutter sections secured together.

15. In the sign structure recited in claim 14, wherein each of said shutter sections have interlocked keys and keyways for securing said shutter sections together.

16. In the sign structure recited in claim 15, wherein said interlocked keys and keyways have hook and eye members engaged in said shutter sections.

17. In the sign structure recited in claim 14, wherein one of said indicia areas comprises a panel having signage for selectively indicating one of an open operative condition and a closed operative condition.

* * * * *